US005437332A

United States Patent [19]

Pfeffer

[11] Patent Number: 5,437,332

[45] Date of Patent: Aug. 1, 1995

[54] CONTROL SYSTEM FOR WILD OIL AND GAS WELLS AND OTHER UNCONTROLLED DANGEROUS DISCHARGES

[76] Inventor: John L. Pfeffer, 833 Howard Ave., New Orleans, La. 70113

[21] Appl. No.: 122,127

[22] Filed: Sep. 16, 1993

Related U.S. Application Data

[63] Continuation-in-part of Ser. No. 683,449, Apr. 10, 1991.

[51] Int. Cl.[6] ..... A62C 3/00

[52] U.S. Cl. ..... 166/364; 169/69

[58] Field of Search ..... 166/363, 364, 75.1, 166/243; 169/69

[56] References Cited

U.S. PATENT DOCUMENTS

| | | | |
|---|---|---|---|
| 1,351,700 | 8/1920 | Smith . | |
| 1,520,288 | 11/1924 | Featherstone . | |
| 1,599,826 | 8/1925 | Leinhard et al. . | |
| 1,679,243 | 7/1928 | Fasul . | |
| 1,807,498 | 5/1931 | Teed . | |
| 1,830,061 | 11/1931 | Howe . | |
| 1,857,788 | 12/1932 | Murphy . | |
| 1,859,606 | 5/1932 | Sievern et al. . | |
| 3,086,465 | 4/1963 | Montfort . | |
| 3,554,290 | 1/1971 | Verdin | 166/364 X |
| 3,724,555 | 2/1972 | Chiasson et al. . | |
| 3,730,278 | 5/1973 | Roy . | |
| 3,815,682 | 6/1974 | Chaisson et al. . | |
| 4,316,506 | 2/1982 | Poole . | |
| 4,323,118 | 4/1982 | Bergmann . | |
| 4,337,831 | 7/1982 | Thaxton . | |
| 4,433,733 | 2/1984 | Cunningham . | |
| 4,588,510 | 5/1986 | Salyer et al. . | |
| 4,899,827 | 2/1990 | Poole . | |

FOREIGN PATENT DOCUMENTS

| | | | |
|---|---|---|---|
| 2002839 | 2/1979 | United Kingdom | 166/364 |

*Primary Examiner*—William P. Neuder
*Attorney, Agent, or Firm*—C. Emmett Pugh; Pugh Associates

[57] ABSTRACT

A control system for wild oil and gas wells etc. using a centered, angled tubular device placed over and attached to the well head by clamps and remotely controlled hydraulic cylinders. The discharge of the well is directed into the bottom of the device, having movable blades forming two apertures used to minimize the induction of air from the exterior. Inert gas from engines powering pumps is injected into the space between the apertures, so that greater than atmospheric pressure in this chamber will result in the outflow of inert gas and prevent induction of air. Inert gas can also be injected into the main body of the device when required to prevent combustion. High pressure motive fluid is discharged from nozzles within the angled chamber of the device, directing the oil and liquids which impinge on the upper surface of the tube to be directed by baffles to its bottom, then flowing into a collecting trough and drawn through slots in the trough bottom by fluid jet eductors. The collected discharge is then directed up a separate tube by jets adding velocity head to the stream, causing it to flow down the length of the device to a remote separator for disposal or storage. The well gas is directed up the tube by high pressure fluid discharged through nozzles providing a fan shaped spray to impart an initial velocity to the gas. Blowers at the discharge end of the gas system disposes the gas, dependent, upon its volume.

22 Claims, 4 Drawing Sheets

CONTROL SYSTEM FOR WILD OIL AND GAS WELLS AND OTHER UNCONTROLLED DANGEROUS DISCHARGES

REFERENCE TO RELATED APPLICATION

This application is a continuation-in-part of pending patent application Ser. No. 07/683,449 filed on Apr. 10, 1991, entitled "Apparatus for Extinguishing and Controlling a Well Fire," the disclosure of which is incorporated herein by reference.

TECHNICAL FIELD

The present invention is directed to a control system for wild oil and gas wells and other uncontrolled dangerous discharges, and more particularly to a device and associated methodology which will capture the discharge of, for example, wild oil or gas wells, while preferably also extinguishing the wells and providing for the separation of the gas from the fluid discharge and for the storage or disposal of them.

Additional uses are for the capture and control of uncontrolled streams of other products, particularly dangerous, caustic or flammable materials, for example, discharge of liquid petroleum gas, liquid natural gas which occur as the result of tractor trailer and railroad car wrecks, etc. Likewise, the timely capture and disposal of the escaping gas by firefighters would prevent destructive BLEVIES.

When used on land, an embodiment of the capture device of the invention is mounted on, for example, a specially designed vehicle or tractor trailer so that it preferably is unitized with whatever motive pumps, blowers, storage tanks and disposal pumps which might be required.

When used on offshore platforms, an embodiment of the capture device of the invention is mounted, for example, on a specially designed derrick barge with all of the required equipment and tanks. Remote controlled clamps for attaching the device over the well head are controlled, for example, from an observation tower on the barge or, for further example, from TV cameras on the device with monitors at the crane control. The support of the device and its discharge tube is, for example, from a hook on the boom of the derrick barge, which preferably is provided with a motion compensator similar to those used for drilling conductor pipe tensioners.

In addition to providing a safe manner for the approach and control of wild wells and minimizing any damage due to fire, the capture and control device of the present invention greatly reduces pollution due to, for example, the uncontrolled discharge from a "wild" well during an uncontrolled blow out and allows the salvaging of the liquid components of the wild well, reducing the loss of production.

BACKGROUND ART

A list of prior patents which may be of interest is provided below:

| U.S. Pat. No. | Inventor | Issue Date |
|---|---|---|
| 1,351,700 | Smith | 08/31/1920 |
| 1,520,288 | Featherstone | 11/23/1924 |
| 1,599,826 | Leinhard et al | 08/29/1925 |
| 1,679,243 | Fasul | 07/31/1928 |
| 1,807,498 | Teed | 05/26/1931 |

-continued

| U.S. Pat. No. | Inventor | Issue Date |
|---|---|---|
| 1,830,061 | Howe | 11/03/1931 |
| 1,857,788 | Murphy | 12/26/1932 |
| 1,859,606 | Sievern et al | 05/24/1932 |
| 3,086,465 | Montfort | 04/23/1963 |
| 3,554,290 | Verdin | 01/12/1971 |
| 3,724,555 | Chiasson et al | 02/29/1972 |
| 3,730,278 | Roy | 05/01/1973 |
| 3,815,682 | Chaisson et al | 06/11/1974 |
| 4,316,506 | Poole | 02/23/1982 |
| 4,323,118 | Bergmann | 04/06/1982 |
| 4,337,831 | Thaxton | 07/06/1982 |
| 4,433,733 | Cunningham | 02/28/1984 |
| 4,588,510 | Salyer et al | 05/13/1986 |
| 4,899,827 | Poole | 02/13/1990 |

In the parent application directed to an "Apparatus for Extinguishing and Controlling a Well Fire," one method proposed in that application is to remove the discharge from the well was the use of a fluid eductor, using a supply of water or using the oil discharge of the well as the motive fluid to capture the discharge of the well, so that it could be controlled and removed from the immediate area of the well to permit work on the well.

A ten inch (10") eductor was built and tested with the well discharge simulated both by a stream of water and by a simulated well on fire comprised of the discharge under pressure of diesel oil and propane. The test device successfully functioned with the simulated streams tested. Such a device can be used, for example, on wells discharging oil only or wells with low gas-oil ratios.

It was apparent that, for wells discharging a sizable amount of natural gas in addition to the oil, the fluid jet eductor would not be completely suitable due to the size required.

The present invention was made in order to efficiently handle the discharge of oil wells, including oil wells with high gas-oil ratios, or gas wells, as well as other uncontrolled dangerous discharges.

GENERAL DISCUSSION OF INVENTION

The preferred embodiment of the present invention is directed to a tubular device which is placed over the well head by any of the several methods described herein. The device is preferably centered over the well head and held the proper distance from it by, for example, clamps and remotely controlled hydraulic cylinders, so that the discharge of the well is directed into the bottom of the device.

A system of movable blades form two apertures which are used to minimize the induction of air from the exterior. Inert gas from, for example, engines powering the pumps or liquified inert gas tanks is injected into the space between the apertures and into the chamber above.

The main chamber of the device is preferably at an angle to the discharge of the well so that the oil and liquids impinge on the upper surface of the tube and are directed by baffles and motive liquid spray to the bottom of the tube. The oil and liquids flow into a collecting trough and are drawn through slots in the bottom of this trough by fluid jet eductors. It is then preferably directed up a separate tube by jets, which add velocity head to the stream to cause it to flow down the length of the device to a remote separator (generally designated as "S" in FIG. 1) for disposal or storage. The mixture of the well discharge stream (oil and gas) expands as it escapes the well and is captured in the device D.

The gas preferably is directed up the tube by high pressure fluid discharged through nozzles, which provide a fan shaped spray to increase the velocity of the gas. Blowers at the discharge end of the gas system or axial blowers in the tube can be provided if required to dispose of the gas, dependent, for example, upon its volume.

Thus, in the preferred embodiment, with the inclination of the device and the various baffle, vane and eductor and jet subsystems used, the liquid flow and gas flow are separated and disposed of or otherwise separately processed. The system of the invention can be used for oil wells regardless of their gas/oil ratio and on gas wells irrespective of their liquid content.

It is thus an object of the invention to provide a more effective and improved control system for, for example, wild oil or gas wells or other uncontrolled streams of dangerous materials.

It is a further object to provide such a system which efficiently handles the discharge of oil wells, including oil wells with high gas-oil ratios, or gas wells or other uncontrolled streams of dangerous materials.

It is also an object to provide a safe manner for the approach and control of wild wells which are on fire, extinguishing the fire, containing and removing the discharge, and permitting remedial work on the well head.

It is an additional an object to provide a safe manner for the approach and control of wild wells which are not on fire and minimize damage due to any fire and to salvage the oil produced which would otherwise be lost.

It is likewise an object to greatly reduce the pollution due to, for example, the uncontrolled discharge of a well during an uncontrolled blow out.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
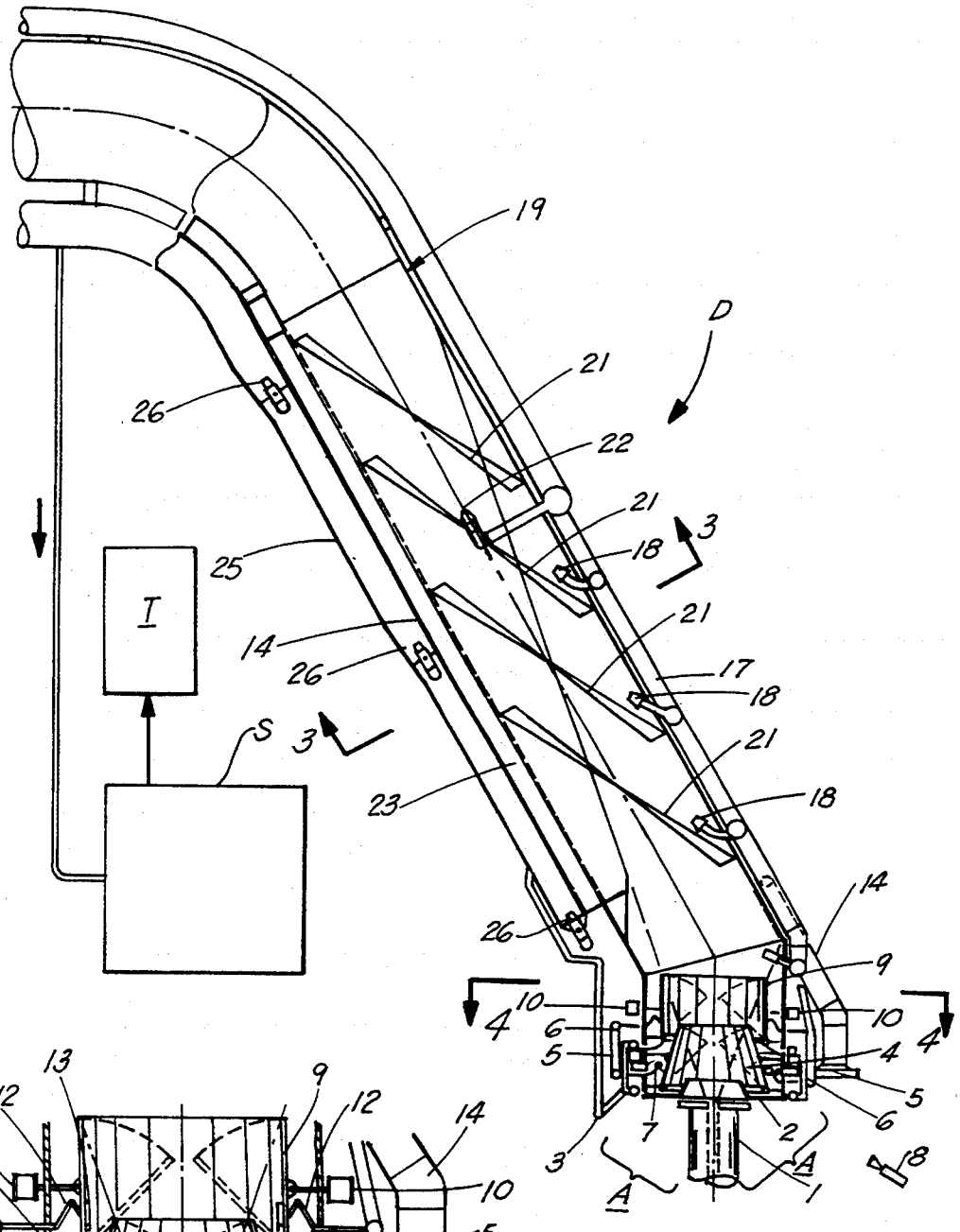
FIG. 1 is a vertical, side cross-sectional view of the separator and capture sections of the exemplary, preferred embodiment of the control and capture device of the present invention in position over an exemplary blown well, illustrating the capture, extinguishing and separation aspects for a fluid stream discharging from the well achieved by the exemplary embodiment of the invention.
Figure 1A:
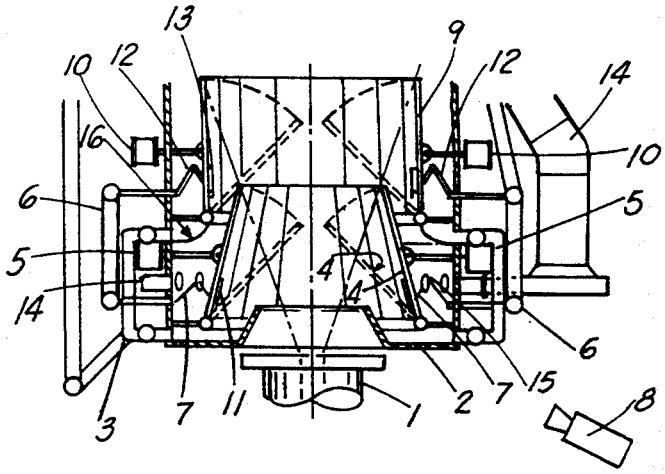
FIG. 1A is an enlarged, detail, side view of the lower section of FIG. 1.
Figure 2:
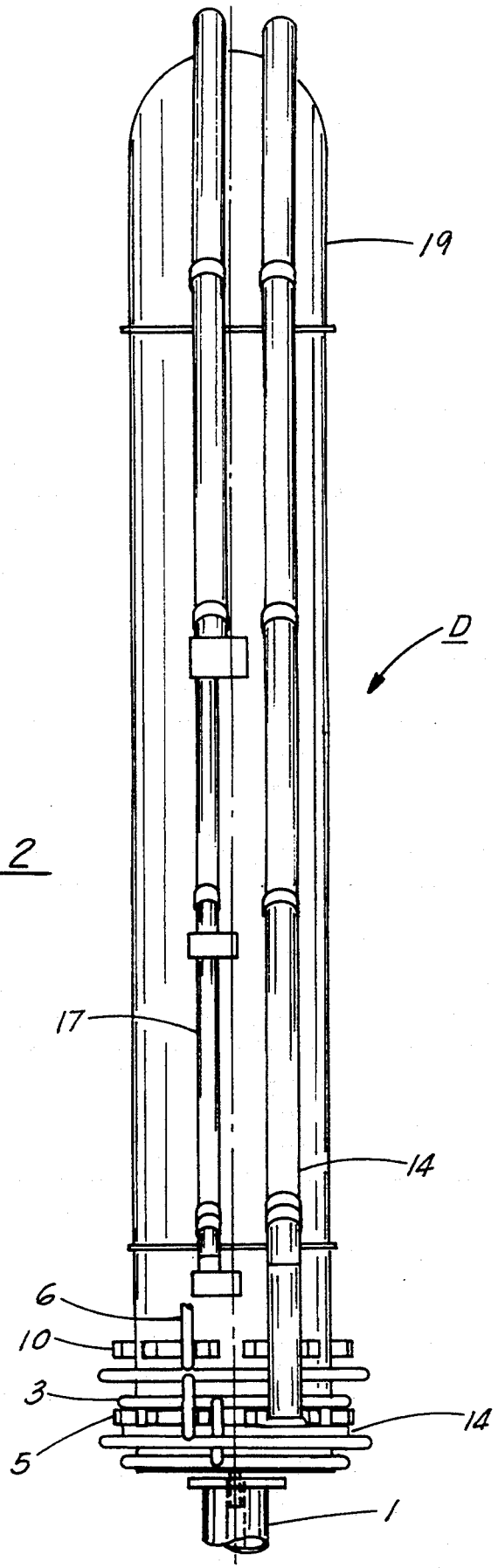
FIG. 2 is an elevation view of the back-side of the separator and capture section of the exemplary device of FIG. 1 (as viewed from the right side of that figure), showing the piping and exterior configuration of this portion of the device.
Figure 3:
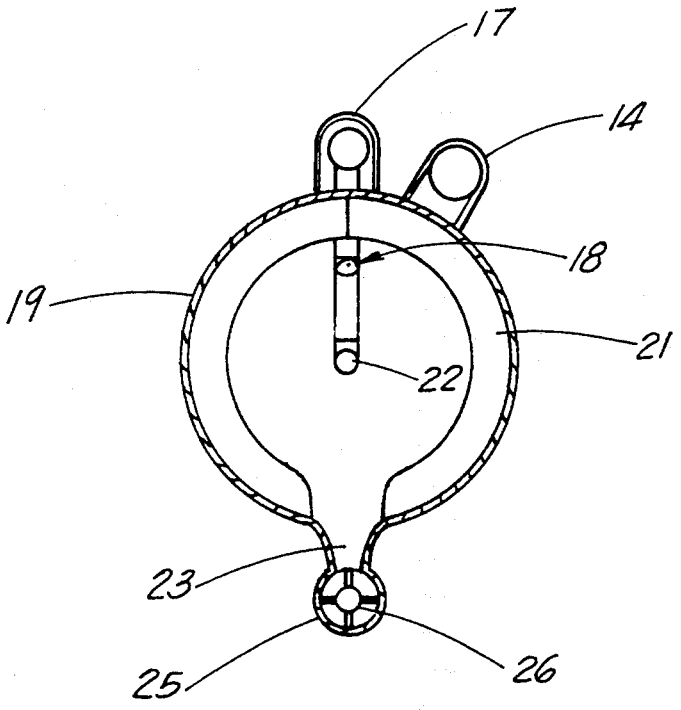
FIG. 3 is a cross-sectional view (taken along section lines 3—3 of FIG. 1) through the separator section of the exemplary device showing inter alia its gas separator chamber, fluid collection trough and liquid capture and discharge tube.
Figure 4:
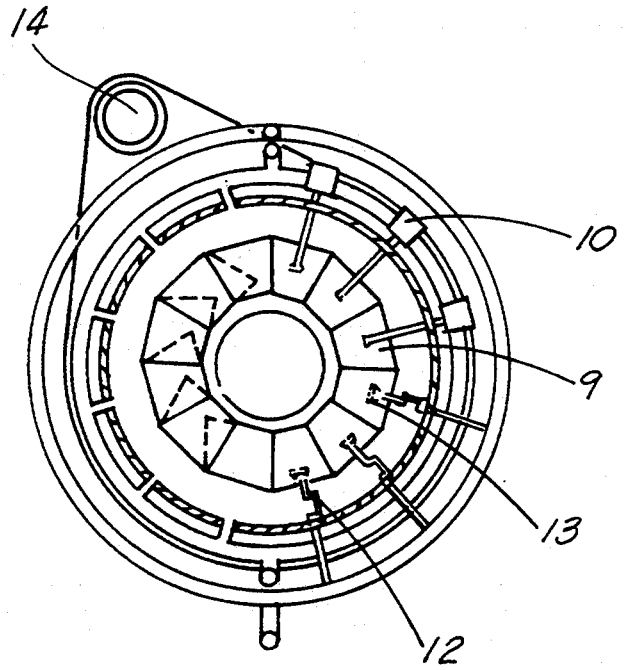
FIG. 4 is a cross-sectional view (taken along section lines 4—4 of FIG. 1) through the capture section of the exemplary device showing inter alia the adjustable vanes controlling the apertures and their related control cylinders, the high pressure jets on the exterior of the lowest vanes shaping and directing any of the well discharge which strikes them up into the device.

With reference to FIGS. 1–5A, when a well goes "wild" typically a high pressure stream of gas and oil is discharged from the well head 1 in a diverging stream, caused by the expansion of gas. With the exemplary device D of the invention in place on the "wild" well and attached thereto by appropriate attachment means, for example, clamping attachments A, for clamping or otherwise attaching the device to the well head 1, the two apertures noted in the discussion above and the space between them are controlled to permit the entry of the well discharge into the interior of the device and to minimize the induction of air, the presence of which air would otherwise permit the combustion of the discharge.

The bottom portion of the exemplary, illustrated device D contains an opening with a coaming through which the well discharge enters. Oil from above, which is not captured by the capture means described below, drains into the bottom of the device D and is drained out by piping 3, including a connected section pipe, powered by the eductor portion of the device.

Movable vanes 4 in the lower aperture are powered by individual hydraulic cylinders 5, which, by moving the vanes in unison, control the size of the aperture opening.

A very high pressure piping system 6 supplies fluid through a system of swivels or heat resistant hoses 7 to a fan shaped jet nozzle 11 on the bottom of each vane. These jet nozzles carry any of the well discharge which hits the vanes into the upper sections of the device D and shape the sides of the well discharge stream. The opening in this aperture is controlled by regulating the hydraulic pressure in this circuit to control the force on the vanes 4 to a level where they will be held against the well discharge stream. A manual adjustment of this system preferably is provided, so that the vanes can be manually moved from a remote location dependent upon the behavior of the entrance as viewed remotely from a TV camera 8.

An upper aperture, with vanes 9 powered by hydraulic cylinders 10 (note also FIG. 4) and with very high pressure piping 6 through high pressure hose or swivels 12 to fan shaped nozzles 13 directed on the upper vanes, function in combination in the same manner as the lower aperture vane subsystem 4–7 to permit the well discharge into the interior device, while limiting the intake of air. These vanes 9, which would be fully open at the beginning of the capture, would be partially closed by regulating the hydraulic pressure actuating them to attain maximum closing on the discharge stream. The flow in drain piping 3 is monitored to achieve the optimum setting.

In order to further reduce the entry of air, inert gas from the engine exhaust of the pump engines is preferably conducted to the bottom of the device D through a pipe 14 and distributed to the portion of the capture section between the apertures through openings 15 in the sides. A supply of liquified inert gas is preferably also connected to this piping, so that accidental ignition of gas within the device D can be extinguished by the injection of a large amount of inert gas. This system can be connected, for example, to high temperature sensors within the discharge of the device to be actuated automatically in the event of a fire in the device.

A trough 16 collects any fluids not captured, which fluids are then sucked into a suction manifold, as is the discharge from the bottom of the device D at a discharge opening 2.

As the well discharge stream enters the separation portion of the device D, due to angular placement of the tubular structure 19, which angle is of the order of at least about twenty (20°) degrees off from the vertical, the well discharge stream impinges upon the tubular body 19 of the device, causing the liquid portion of the stream to follow the diversion vanes 21 to the lower side of the tube (note also FIG. 3), and then through the open area 23 to the oil discharge tube 25. Motive water from the motive water pump system is supplied through pipe 17 to the nozzles 18 which discharge the motive water in a fan-shaped spray. This spray causes the liquid portion of the discharge to move to the lower side of the tube. A source of motive water, either supplied by the same system as the pump system supplying the pipe 17 or by a separate pump supplying a nozzle 22 which increases the velocity of the gas portion of the well discharge, propels it up the body of the separation device D (note also FIG. 5).

The gas separately discharges through the main body of the device D, down the gas discharge tube. Blowers preferably can be used, if so desired, in this system to increase the velocity of the gas stream or to provide increase in the discharge pressure. The gas is then separately led to a safe location and disposed of by flaring until the well is brought under control.

Figure 5:
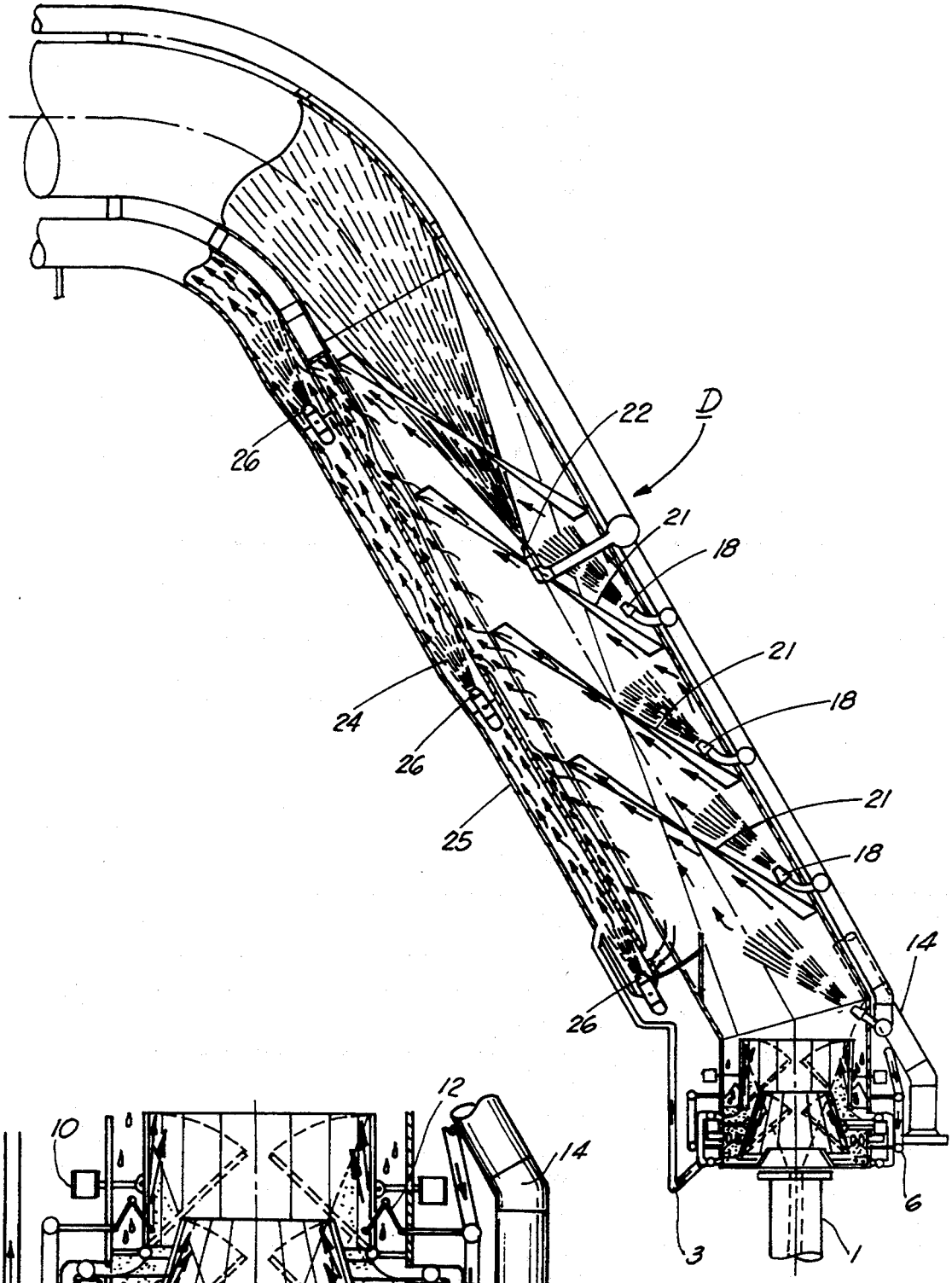
FIG. 5 and FIG. 5A are the same vertical, cross-sectional views of the separator and capture sections of the exemplary device as shown in FIGS. 1 & 1A, respectively, but with the entrance of the well discharge shown as well as the motive fluid jets for the operation of the device, with directional arrows being used to show the flow of the oil, gas, and motive fluids through the device.
Figure 5A:
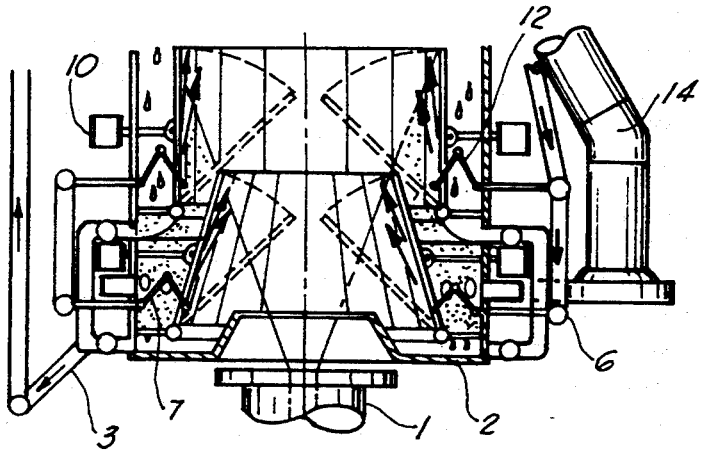

As can be seen in FIG. 5, the separator section of the device D, the well discharge fluids, as well as most of the motive fluid discharged by nozzles 18, are directed to the lower side of the sloped tube and into a trough, and are pulled through slots 24 in the bottom of that trough by the reduced pressure in the oil discharge tube 25 by eductor jets 26. The oil and well liquids are discharged through the liquid discharge pipe to an oil-gas-water separator S with the separated oil directed to a storage tank T (note FIG. 1). The water is either reused as motive water or disposed of in accordance with local requirements. Pumps can be used, if so desired, at the discharge end of the device D to provide for discharge conditions.

When the device D is first placed over the well, any debris in the area might be sufficiently hot to interfere with its operation. Nozzles on the exterior of the device D can be connected by suitable piping to a source of cooling water which will provide cooling to the device and its surroundings.

A suitable mounting frame (not illustrated for the sake of simplicity) preferably is supplied on the bottom of the device D, providing support and guidance for, for example, tools used in the control of the well.

Upon placement of the device over the "wild" well, the well fire is extinguished. After the surroundings cool off, the area can be approached in comparative safety for the purpose of further bringing the well under control. During these operations, the well discharge is controlled by the device D for the safety of those working on the well, and, due to the presence and operation of the device, the damage and pollution that otherwise would have occurred will be greatly reduced.

The source of the motive fluid for offshore applications preferably would be sea water. However, for land applications, the initial motive water, which would be brought to the location, would soon be lost in the separation process. In the event of no water supply for motive water, then oil could be used for the motive fluid. The pumps and piping materials of the device D preferably are suitable for both.

Surplus oil on land applications could be transported, for example, via hose to remote storage pits. In offshore operations, the derrick barge, used for example, to install the device D on the well head 1, could be fitted with suitable tanks (T) to store the initial oil discharge, which thereafter could be off-loaded to transport barges.

Although wild oil and gas wells are a particularly efficacious application for the invention, it should be understood that the invention is also applicable to handling other uncontrolled streams of other products, particularly dangerous, caustic or flammable materials, for example, discharge of liquid petroleum gas, liquid natural gas which occur as the result of tractor trailer and railroad car wrecks, etc. Likewise, the timely capture and disposal of the escaping gas by firefighters would prevent destructive BLEVIES.

It is noted that the embodiment described herein in detail for exemplary purposes is of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A control system for an uncontrolled discharge from a wild oil or gas well or other uncontrolled stream of dangerous material having a discharge opening producing a highly pressurized fluid discharge stream, which system utilizes a device which captures at least in substantial part the discharge stream from the discharge opening, comprising:

an elongated structure having an hollow interior placed over and attached to the discharge opening, causing the discharge to enter into the interior of said structure, said elongated structure having a bottom portion and an upper portion, with the direction of elongation of said structure between said bottom portion and said upper portion substantially diverging away from the vertical at an angle, causing the discharge from the discharge opening to impinge on the interior, angled surface of said structure;

a first set of movable vanes and actuating means associated with said first set of vanes for moving its associated vanes under force located in said bottom portion; and a second set of movable vanes and actuating means associated with said second set of vanes for moving its associated vanes under force located in said upper portion.

2. The wild well control system of claim 1, wherein there is further included:

an inert gas subsystem associated with said elongated structure injecting inert gas into the interior of said elongated structure's bottom portion, assisting in the prevention of the discharge into the interior of said structure from igniting.

3. The wild well control system of claim 2, wherein there is further included:

monitoring means associated with said structure for measuring the temperature and pressure within said structure at multiple locations; and control means associated with said monitoring means for controlling said inert gas subsystem based on the temperature and pressure being monitored by said monitoring means.

4. The wild well control system of claim 1, wherein:

said bottom portion of said elongated structure is attached to the discharge opening by means of clamp attachments.

5. The wild well control system of claim 1, wherein:

said angle is of the order of at least about twenty (20°) degrees off from the vertical.

6. The wild well control system of claim 1, wherein there is further included:

a TV system showing a portion of the interior of said structure, providing information used to determine the positioning of said vanes in at least said bottom portion of said structure.

7. The wild well control system of claim 1, wherein there is further included:

control subsystem means associated with said structure for controlling flow and pressure to the hydraulic means controlling said two sets of vanes, including flow monitoring of the drained fluid.

8. The wild well control system of claim 1, wherein:

said bottom portion of said elongated structure is centered over the discharge opening and is attached thereto by means of clamp attachments.

9. The wild well control system of claim 1, wherein there is further included:

monitoring and control means associated with said structure for monitoring and controlling the motive fluid systems in said structure, allowing it to be more efficiently operated over extended periods of time.

10. The wild well control system of claim 1, wherein:

the discharge is directed into the bottom of said structure; and wherein said structure further includes:

movable blades forming a multiple number of apertures used to minimize the induction of air into said interior of said structure from the exterior surroundings.

11. The wild well control system of claim 1, wherein the interior of said structure further includes:

baffles, at least one collecting trough having a bottom with openings in it, and jet eductors, all located in said bottom portion, the discharge opening discharge after impinging on the upper surface of the tube being directed by said baffles to the bottom of the structure, with it then flowing into said collecting trough and drawn through said openings in said trough bottom by said fluid jet eductors, forming a collected discharge.

12. The wild well control system of claim 1, wherein:

said structure has a tubular shape.

13. The wild well control system of claim 9, wherein there is further included:

a separate tube;

additional jets; and a remote separator;

said collected discharge then being directed up said separate tube by said additional jets adding velocity head to the stream, causing it to flow down the length of said elongated structure to said remote separator for disposal or storage.

14. The wild well control system of claim 1, wherein there is further included:

separator means located in the interior of said structure for at least partially separating out the liquid and gas components of the discharge stream and conveying them outside of said structure.

15. The wild well control system of claim 14, wherein there is further included:

a well gas tube; and a series of nozzles;

the well gas from the discharge stream being directed up the tube by high pressure fluid discharged through said nozzles providing a fan shaped spray, imparting an initial velocity to the gas.

16. A method of capturing at least in substantial part the discharge stream from a wild oil or gas well or other uncontrolled stream of dangerous material having a discharge opening producing a highly pressurized fluid discharge stream at the discharge opening, comprising the following steps:

a) placing an elongated structure having an hollow interior over the discharge opening and attaching it to the discharge opening, causing the discharge to enter into the interior of said structure, said elongated structure having a bottom portion and an upper portion, with the direction of elongation of said structure between said bottom portion and said upper portion substantially diverging away from the vertical at an angle, causing the discharge from the discharge opening to impinge on the interior, angled surface of said structure;

using a first set of movable vanes and actuating means associated with said first set of vanes for moving its associated vanes under force located in said bottom portion; and using a second set of movable vanes and actuating means associated with said second set of vanes for moving its associated vanes under force located in said upper portion to control the discharge.

17. The method of claim 16, wherein there is included the further step of:

at least partially separating out the liquid and gas components of the discharge stream using separator means located in the interior of said structure and conveying the separated components outside of said structure.

18. The method of claim 16, wherein there is included the further preliminary step of:

locating said structure to cause the discharge opening discharge to impinge on the upper surface of the tube, and, after its impingement, directing the impinged discharge by baffles to the bottom of the structure, allowing it to then flow into a collecting trough and drawing it through openings in the bottom of said trough using fluid jet eductors, forming a collected discharge.

19. The method of claim 16, wherein there is included the further step of:

positioning said structure with respect to the discharge opening during operation at an angle of the order of at least about twenty (20°) degrees off from the vertical.

20. The method of claim 16, wherein there is included the further step of:

using a TV system to show at least a portion of the interior of said structure and thereby obtaining information used to determine the positioning of said vanes in at least said bottom portion of said structure.

21. The method of claim 16, wherein there is included one or more of the further steps of:

controlling flow and pressure to the hydraulic means to control said two sets of vanes, and monitoring the flow of the drained fluid;

monitoring and controlling the motive fluid systems in said structure, allowing it to more efficiently operated over extended periods of time;

attaching the bottom portion of said elongated structure to the discharge opening by means of clamp attachments;

directing the collected discharge up a separate tube by using jets to add velocity head to the stream, causing it to flow down the length of said elongated structure to a remote separator for disposal or storage; and/or directing the well gas from the discharge stream up the tubular structure by high pressure fluid discharged through said nozzles providing a fan shaped spray, imparting an initial velocity to the gas.

22. A control system for a wild oil or gas well or the like having a well head producing a highly pressurized fluid discharge stream, which system utilizes a device which captures at least in substantial part the discharge stream from the well head, comprising:

an elongated structure having an hollow interior placed over and attached to the well head, causing the discharge to enter into the interior of said structure, said elongated structure having a bottom portion and an upper portion, with the direction of elongation of said structure between said bottom portion and said upper portion substantially diverging away from the vertical at an angle, said angle being of the order of at least about twenty (20°) degrees off from the vertical, causing the discharge from the well head to impinge on the interior, angled surface of said structure, said bottom portion of said elongated structure being centered over the well head and being attached thereto by means of clamp attachments, the discharge of the well being directed into the bottom of said structure;

a first set of movable vanes and actuating means associated with said first set of vanes for moving its associated vanes under force located in said bottom portion;

a second set of movable vanes and actuating means associated with said second set of vanes for moving its associated vanes under force located in said upper portion;

movable blades forming a multiple number of apertures used to minimize the induction of air into said interior of said structure from the exterior surroundings;

the interior of said structure further including baffles, at least one collecting trough having a bottom with openings in it, and jet eductors, all located in said bottom portion, the well head discharge after impinging on the upper surface of the tube being directed by said baffles to the bottom of the structure, with it then flowing into said collecting trough and drawn through said openings in said trough bottom by said fluid jet eductors, forming a collected discharge;

an inert gas subsystem associated with said elongated structure injecting inert gas into the interior of said elongated structure's bottom portion, assisting in the prevention of the well discharge into the interior of said structure from igniting;

a separate tube;

additional jets;

a remote separator;

said collected discharge then being directed up said separate tube by said additional jets adding velocity head to the stream, causing it to flow down the length of said elongated structure to said remote separator for disposal or storage;

a well gas tube;

a series of nozzles;

the well gas from the discharge stream being directed up the tube by high pressure fluid discharged through said nozzles providing a fan shaped spray, imparting an initial velocity to the gas;

monitoring means associated with said structure for measuring the temperature and pressure within said structure at multiple locations;

control means associated with said monitoring means for controlling said inert gas subsystem based on the temperature and pressure being monitored by said monitoring means;

a TV system showing a portion of the interior of said structure, providing information used to determine the positioning of said vanes in at least said bottom portion of said structure;

monitoring and control means associated with said structure for monitoring and controlling the motive fluid systems in said structure, allowing it to to be more efficiently operated over extended periods of time; and control subsystem means associated with said structure for controlling flow and pressure to the hydraulic means controlling said two sets of vanes, including flow monitoring of the drained fluid; and separator means located in the interior of said structure for at least partially separating out the liquid and gas components of the discharge stream and conveying them outside of said structure.

* * * * *